US006740200B2

(12) United States Patent
Seymour et al.

(10) Patent No.: US 6,740,200 B2
(45) Date of Patent: May 25, 2004

(54) METHODS AND SYSTEM FOR MANUFACTURING AND FINISHING WEB PRODUCTS AT HIGH SPEED WITHOUT REELING AND UNWINDING

(75) Inventors: Robert J. Seymour, Appleton, WI (US); John R. Hanson, Appleton, WI (US); E. Kent Isom, Appleton, WI (US); James L. Baggot, Menasha, WI (US); Steven J. Wojcik, Little Chute, WI (US); Kenneth A. Pigsley, Greenville, WI (US); Robert L. Clarke, Appleton, WI (US); Randall J. LeValley, Neenah, WI (US); Charles H. Goerg, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/025,382

(22) Filed: Dec. 19, 2001

(65) Prior Publication Data

US 2003/0113457 A1 Jun. 19, 2003

(51) Int. Cl.[7] ..... D21F 11/00; D21H 25/04

(52) U.S. Cl. ..... 162/118; 162/111; 162/112; 162/117; 162/123; 162/134; 162/135; 162/191; 162/193; 162/194; 162/197; 162/204; 162/207

(58) Field of Search ..... 100/102 R; 118/641; 162/109–122, 201, 204–207, 280, 283, 288, 287, 381; 242/160.1, 160.2, 364.1, 521–523, 523.1, 526, 526.1, 528, 532, 548; 34/111, 114–123, 623–625, 444, 447, 454, 466

(56) References Cited

U.S. PATENT DOCUMENTS

| | | | | | |
|---|---|---|---|---|---|
| 999,375 | A | * | 8/1911 | Liebeck | 162/283 |
| 1,315,924 | A | * | 9/1919 | Fuller | 162/283 |
| 1,585,977 | A | * | 5/1926 | Hall | 162/286 |
| 1,842,889 | A | * | 1/1932 | Williams | 162/283 |
| 3,756,527 | A | | 9/1973 | Collins et al. | |
| 4,087,319 | A | * | 5/1978 | Linkletter | 162/283 |
| 5,129,568 | A | | 7/1992 | Fokos et al. | |
| 5,254,399 | A | | 10/1993 | Oku et al. | |
| 5,591,309 | A | * | 1/1997 | Rugowski et al. | 162/113 |
| 5,593,545 | A | * | 1/1997 | Rugowski et al. | 162/207 |
| 5,756,156 | A | | 5/1998 | Elijoki et al. | |
| 5,806,432 | A | * | 9/1998 | Kurth | 101/488 |
| 6,030,496 | A | | 2/2000 | Baggot et al. | |
| 6,076,281 | A | * | 6/2000 | Kilpia et al. | 34/457 |
| 6,355,139 | B1 | | 3/2002 | Baggot et al. | |

FOREIGN PATENT DOCUMENTS

| | | | |
|---|---|---|---|
| EP | 0617164 | A1 | 3/1994 |
| EP | 1008690 | A2 | 11/1999 |
| EP | 1063350 | A2 | 12/2000 |
| EP | 1179630 | A1 | 2/2002 |
| WO | WO 8102704 | A1 | 10/1981 |
| WO | WO 9624718 | | 8/1996 |
| WO | WO0016974 | | 3/2000 |
| WO | WO 0185438 | A2 | 11/2001 |
| WO | WO 0238865 | A2 | 5/2002 |

OTHER PUBLICATIONS

Smook, Gary A., Handbook for Pulp & Paper Technologists, Chapter 23, pp. 343–354.*
PCT Search Report dated Mar. 10, 2003.

* cited by examiner

*Primary Examiner*—Steven P. Griffin
*Assistant Examiner*—Eric Hug
(74) *Attorney, Agent, or Firm*—Dority & Manning, P.A.

(57) ABSTRACT

A method for directly forming and finishing a web product is provided. The method includes forming a web on a forming apparatus, continuously transferring the formed web to a conveyor, performing a converting step on the web as the web is continuously supported and advanced on the conveyor, and finishing the web into a product substantially ready for packaging. A system for performing the method is also provided.

30 Claims, 6 Drawing Sheets

METHODS AND SYSTEM FOR MANUFACTURING AND FINISHING WEB PRODUCTS AT HIGH SPEED WITHOUT REELING AND UNWINDING

BACKGROUND OF THE INVENTION

Large parent rolls are presently rolled up on a reel after a web manufacturing process such as during the production of tissue and other paper products. The parent rolls are prepared, stored and eventually transported to be converted and finished. To begin a converting process, the parent roll is unwound, subjected to a variety of conversions and re-wound into, for example, consumer-diameter size rolls called logs. A consumer-diameter size log is then transported to a packaging process where the log is cut into consumer-width size rolls and wrapped as finished product for shipment and subsequent purchase.

At least one drawback in the present state of the art is that parent rolls formed from uncreped through-air dried (UCTAD) tissue webs are prone to cause waste or lost production. The parent roll winding process can be wasteful due to the relative bulkiness of UCTAD tissue webs and the relatively large size of the parent rolls and loose winding tension vary throughout the parent roll. Additionally, thickness and width of the sheets of the parent roll undesirably varies due to different compressive stresses to the sheets in the parent roll at the top of the roll and approaching the core of the roll. The stretch in the sheet also varies in the parent roll due to the compressive forces (as mentioned above) and the wind-up process.

At least one other current disadvantage is that the web may not be completely supported throughout the manufacturing and winding processes. Intermittent support generally requires sheets to have increased tensile strength to pass over lengthy open draws. Also increased sheet tensile strength is necessary to overcome degradation due to winding and unwinding the parent roll before the converting process. However, due to higher web stresses on the sheets, the sheets tend to experience higher incidents of web breaks, which decreases machine efficiency. Such sheets also tend to cost more to manufacture. Higher costs, in turn, can be a competitive disadvantage since costs are likely passed on to the consumers in the form of higher retail prices, which may adversely impact consumer purchasing.

An additional disadvantage in the art is that tissue machine (TM) speeds presently tend to be faster than relatively slower converting process speeds. Accordingly, webs are not continuously moved from TM to the converting process. An intervening parent roll is usually required, which must be subsequently unwound and converted further reducing manufacturing and conversion efficiencies.

SUMMARY OF THE INVENTION

The present invention eliminates the parent roll and its associated reeling and unwinding steps by directly coupling a web-forming tissue machine to converting stations and a winder to make finished roll products. With the elimination of the parent roll and the inherent steps of winding and unwinding prior to converting, unwanted product waste and sheet thickness variability is reduced or eliminated. Additionally, elimination of the parent roll and extraneous winding and unwinding steps permits the web to be continuously moved from the forming step to the converting step, which increases overall manufacturing and finishing efficiencies.

According to an aspect of the invention, a method to transfer any type of sheet from, for example, a web drying system such as tissue, air-laid, non-woven (through-air dried, flat dryer or Yankee dryer) to the beginning of the winder is provided. The method utilizes a controlled sheet transfer from the drying system to the converting winder where a pulper or waste receptacle receives the sheet when the winder is not winding a consumer roll.

The method continuously supports the sheet from the drying or web-forming section to the winding section and allows for several sheet modifications, conversions or finishing steps such as calendering, embossing, s-wrapping (e.g., shear inducing reels to create shear forces that act upon the web to increase the softness of the web), coating, printing, web-separating, ply-bonding, and/or adhesive application prior to a winding or folding process. The sheet may be controlled via a belt, foil, fabric (permeable or non-permeable), air support, or vacuum support in various sections to allow the sheet to be processed through to wind-up without losing control of the sheet. Where small open draws may be required or desired, the method allows for broken web handling ("broke handling") at each finishing or sheet modification station or at the end of the winding process.

According to another aspect of the invention, a web manufacturing system for directly forming and finishing the web product using the disclosed method is provided. The system includes a web-forming apparatus for forming and drying the web product and a conveyance system positioned downstream from a transfer point. The conveyance system continuously receives the web at the transfer point at a standard web processing speed while at least one converting station subsequently finishes the web. Although the system may include small open draws, for instance, to remove broken web, the invention contemplates substantially continuously controlling and supporting the web throughout the system.

Some benefits of the foregoing method and system are:

- improved sheet properties (stretch and bulk or caliper are preserved with the elimination of the parent roll, reel and unwinding steps);
- reduced capital costs due to fewer equipment pieces and no storage requirements for parent rolls;
- reduced finished product variability (e.g., caliper variability in the parent roll sheet properties near the core and at the outside of the roll are eliminated or reduced);
- reduced waste (e.g., no parent roll core, roll dressing thread-up on reel, or threading of the winder);
- improved safety due to less equipment and handling of parent rolls;
- improved climate/environment (e.g., no climate control required for parent rolls and a less dusty environment); and
- increased web manufacturing and finishing efficiencies (e.g., no delay due to parent roll changes and no reel turn-up/thread-up delays).

The exemplary methods and the system described herein are simple, reliable, and economical to manufacture, assemble and use. Other advantages of the invention will be apparent from the following description and the attached drawings or can be learned through practice of the invention.

BRIEF DESCRIPTION OF THE DRAWINGS

The above and other aspects and advantages of the present invention are apparent from the detailed description below and in combination with the drawings, in which.

DETAILED DESCRIPTION OF THE DRAWINGS

Figure 1:
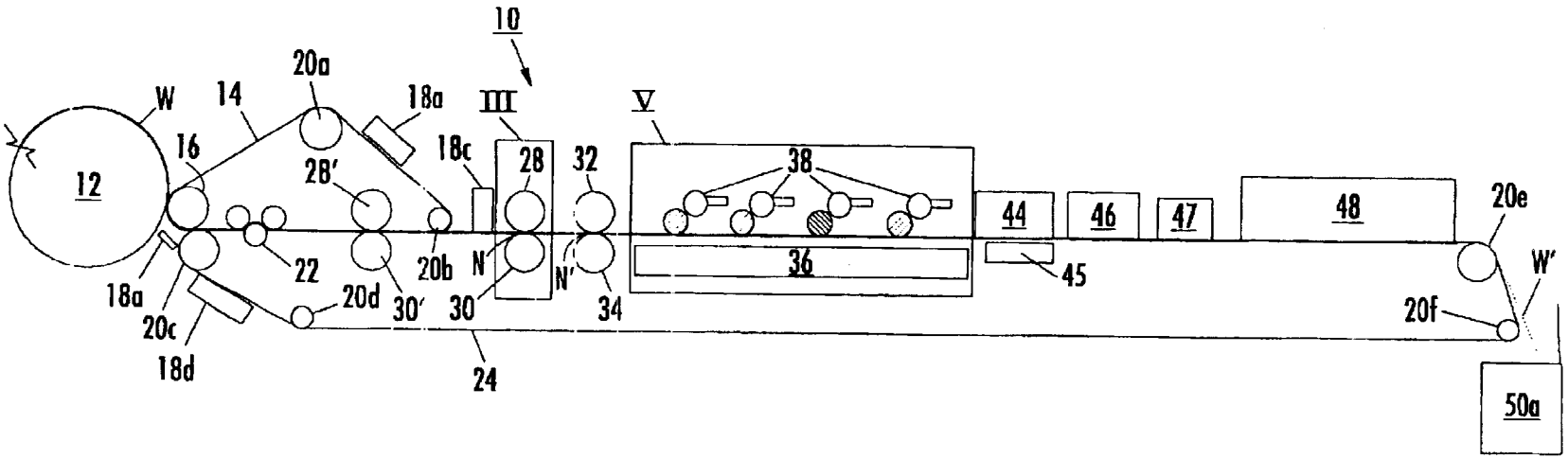
FIG. 1 is a schematic view of an embodiment of a system for performing a method of manufacturing and finishing a web product.

Detailed reference will now be made in which examples embodying the present invention are shown. Repeat use of reference characters is intended to represent same or analogous features or elements of the invention.

The drawings and detailed description provide a full and detailed written description of the invention and the manner and process of making and using it so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the appended claims and their equivalents.

As broadly embodied in the Figures, a web product system for manufacturing, directly forming and finishing a web is provided. In general, the system 10 is configured to facilitate continuous support and movement of web W, which is discussed in detail herein.

As FIG. 1 illustrates, the system 10 may include a paper-forming apparatus or a dryer 12 such as a Yankee or through-air dryer, and a conveyance system such as a pick-up or first conveyor 14 and a second or delivery conveyor 24, which cooperate to pass the web W from the dryer 12 in a direction of a folding or winding station 48. System 10 may include a coater or plurality of coaters 18*a–d*; a plurality of carrier rolls 20*a–f*; an s-wrap reel or shear inducing element 22; a calendering station such as calender roll 28 and opposing roll 30; an embossing station such as pattern roll 32 and backing roll 34; a web attraction device such as a vacuum box 36; a printer station including a plurality of printers 38 for multi-color printing; a perforator 44; a slitter or severing device 45; a gluing station 46; a folding board 47 for producing multiple plies from a single sheet; station 48 for the finished web product, which may be an interfolder for folded products, a turret winder or surface winder to wind-up consumer-diameter "logs" for subsequent cutting into consumer-length for rolled products; and a pulper 50. The foregoing elements and stations and their operation are discussed in greater detail below.

While FIG. 1 illustrates all of the foregoing elements and stations, the system 10 can be configured with any combination or all of the described elements and stations. Moreover, the exemplary elements and stations may be arranged other than as shown. For instance, printers 38 may be disposed upstream of pattern roll 32 and backing roll 34. Further, various quantities of elements may be disposed at various points along the system 10; e.g., another coater (not shown) may be disposed proximate folder 48. Furthermore, additional pulpers such as pulper 50*b* (FIG. 2) may be disposed at various open draws D in system 10, for example, to facilitate cleaning or maintenance operations.

With more particular reference to FIG. 1, the optional pick-up conveyor 14 is disposed adjacent the dryer 12 to pick up the formed and dried web W, which can be any type of formed web, such as a creped paper web or an UCTAD web. At least one way in which conveyor 14 can pick-up web W is by a pick-up or transfer roll 16, which may be configured with a vacuum. By way of example, vacuum-equipped roll 16 can attract web W from dryer 12 across an open draw to the conveyor 14. However, the invention contemplates other pick-up/transfer arrangements such as direct contact between dryer 12 or a dryer fabric (not shown) and conveyor 14.

FIG. 1 further illustrates that after pick-up conveyor 14 picks up the web W, web W is continuously transferred downstream of dryer 12 to be coated by coaters 18*a–d*. It is to be noted that in addition to coaters 18*a–d*, a plurality of other coaters may be disposed throughout system 10 to coat the web W with a plurality of coatings. At least one of the coaters may be a roller and any of the coaters may be configured to coat the web W, the conveyors 14, 24, or combinations of the web W and conveyors 14, 24 to apply the coating to the web W. The coating, for example, may be a lotion formulation that includes from between 5 to about 95 weight percent of an emollient, from between 5 to about 95 weight percent of a wax and from between 0.1 to about 25 weight percent of a viscosity enhancer selected from the group consisting of polyolefin resins, polyolefin polymers, polyethylene, lipophilic-oil thickeners, ethylene/vinyl acetate copolymers, silica, talc, colloidal silicone dioxide, zinc stearate, cetyl hydroxy ethyl cellulose and mixtures thereof.

FIG. 1 indicates that a number of other converting steps may be performed on the web W as it continuously advances on the pick-up conveyor 14 to the delivery conveyor 24. For instance, the coated web W can be subjected to a s-wrap or shear inducing element 22 to create shear forces on web W to increase its softness. Other converting steps may include conveying the web W through at least one calendering nip N formed by calender roll 28 and opposing roll 30 to impart a desired thickness or caliper to the web W. Optionally, the calender roll 28 is a smooth steel roll and the opposing roll 30 is a resilient rubber roll to evenly calender the web W. Moreover, a plurality of calendering stations (e.g., calendar 28' and roll 30') may be provided according to FIG. 1.

If desired, web W may proceed continuously from the calendering station to an embossing station, which may include pattern roll 32, also referred to as an embossing roll, and backing roll 34 that form an embossing nip N'. Embossing is a well-known mechanism to increase sheet caliper, and it also provides an additional benefit by "spot embossing" or imparting a decorative pattern to a tissue product, not further described.

After printing and embossing web W, FIG. 1 further indicates that a web attraction device such as vacuum box 36 may be disposed along system 10 to maintain web W against conveyor 24 to allow printing on one side and then the web W is continuously advanced to a perforator 44 where web W is perforated as known to those in the art. By way of example, the web W can be perforated laterally prior to interfolding or winding.

Severing device 45 is co-operable with perforator 44 to sever the perforated web W into various lengths. The severed web W will proceed to station 48 to be interfolded into folded products or wound on a winder into a rolled product to be subsequently cut into consumer product lengths and packaged, for example, by a turret-type assembly, an example of which is disclosed in U.S. Pat. No. 6,270,034 to Kury et al.

In the event of a broken web W', pulper 50*a* is disposed to receive the broken web W' to permit the remaining web W to continuously advance. One example of an operation of system 10 is that web W is threaded-up (directed along conveyor 24 from dryer 12 to winder 48) until web W reaches pulper 50*a*. As web W is satisfactorily "flowing" along conveyor 24, any and all of the foregoing finishing stations and elements are applied to web W as desired. In the event of a broken web W, the system 10 continues to operate uninterrupted by blowing the broken web W', for example, by air or water jets (not shown) off the conveyor 24 into pulper 50*a*. Simultaneously, an adversely affected log (not shown) is removed from winder 48 and rejected while a new core (not shown) is supplied to winder 48. Also concurrently, a new supply of unbroken web W continues flowing along system 10 for wind-up on the new core at station 48.

Figure 2:
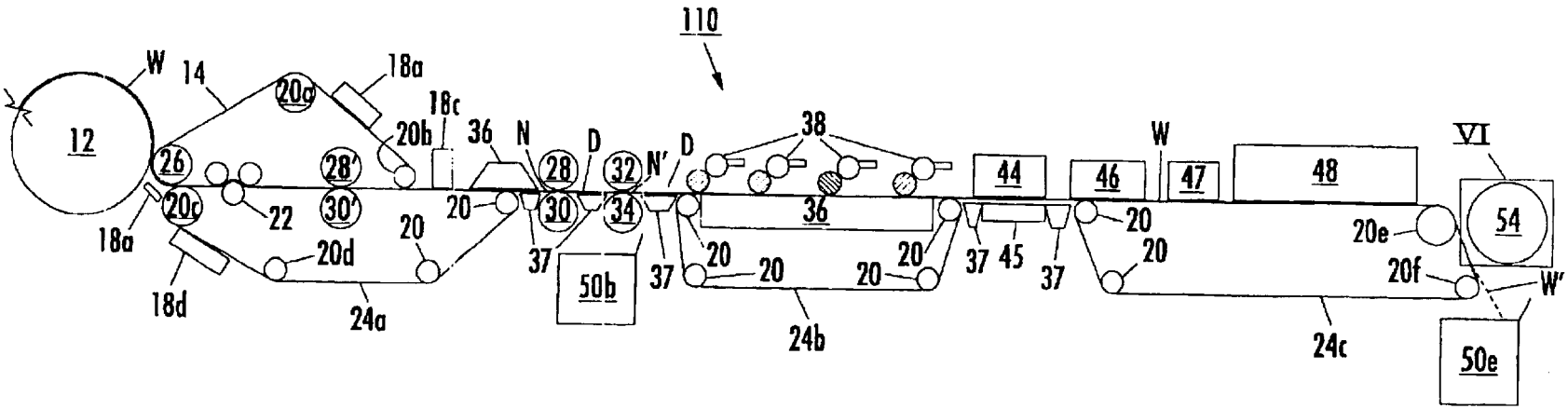
FIG. 2 is a schematic view of an alternative embodiment of a system for performing a method of manufacturing and finishing a web product.

In some ways similar to FIG. 1, FIG. 2 also illustrates continuous support of web W. However, the exemplary system 110 of FIG. 2 further includes, for example, three conveyors 24*a*, 24*b*, and 24*c*, which operate in conjunction with a plurality of web attraction devices such as vacuum boxes 36, static induction devices (not shown), and blow boxes 37 to continuously support the web W across various open draws D.

Advantageously, separate conveyors 24*a*, 24*b*, and 24*c* (additional or fewer conveyors may be used) permit constant web mass flow as various nips N, N' affect a thickness or caliper of web W. Specifically, as web W is calendered by calender 28, for example, the web is made thinner as it passes through the nip N. To ensure the same amount of web or web mass flows towards printing station 38, the speed of stand-alone conveyor 24*b* must and can be increased to maintain an overall constant speed of system 10. In this inventive arrangement, boxes 36, 37 ensure continuous transfer of the web W across draws D so conveyors 24*a*, 24*b*, and 24*c* may operate at different speeds as required. Moreover, complete support of web W allows for reduced tensile strength of the web W, which results in fewer breaks and is less costly to produce than higher tensile strength web. This aspect also has the added advantage of producing a softer product for the consumer.

FIG. 2 finally illustrates an optional parent roll 54, discussed in greater detail in FIG. 6 below, which may be desirable if the web W requires coating and calendering, for instance, but winding or folding into an end-product are desired at a remote facility.

Figure 3:
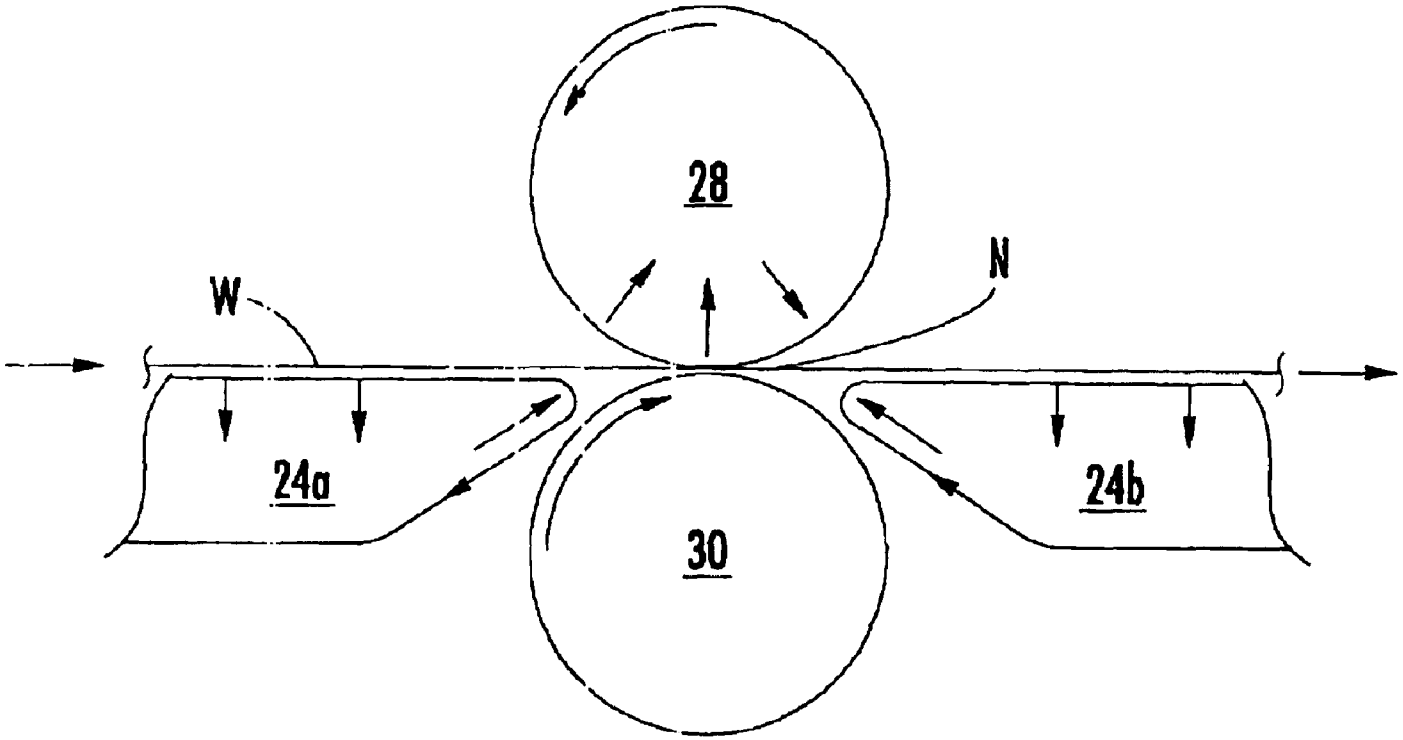
FIG. 3 is an enlarged view of an optional calendering station of the system taken at area III in FIG. 1.

FIG. 3 shows calender roll 28 cooperating with opposing roll 30 to form nip N through which the continuously advancing web W is conveyed by conveyor 24 to impart a desired caliper to the web W. Also, FIG. 3 illustrates continuous support of web W through the calendering run by two sections 24*a*, 24*b* of delivery conveyor 24 as web W passes through nip N. Web W may otherwise be continuously supported in system 10 by a fabric conveyor, a foil, a vacuum shoe, an adjustable vacuum transport conveyor or combinations of the foregoing to support the web W at the standard web processing speed as described in the foregoing embodiment.

Figure 4:
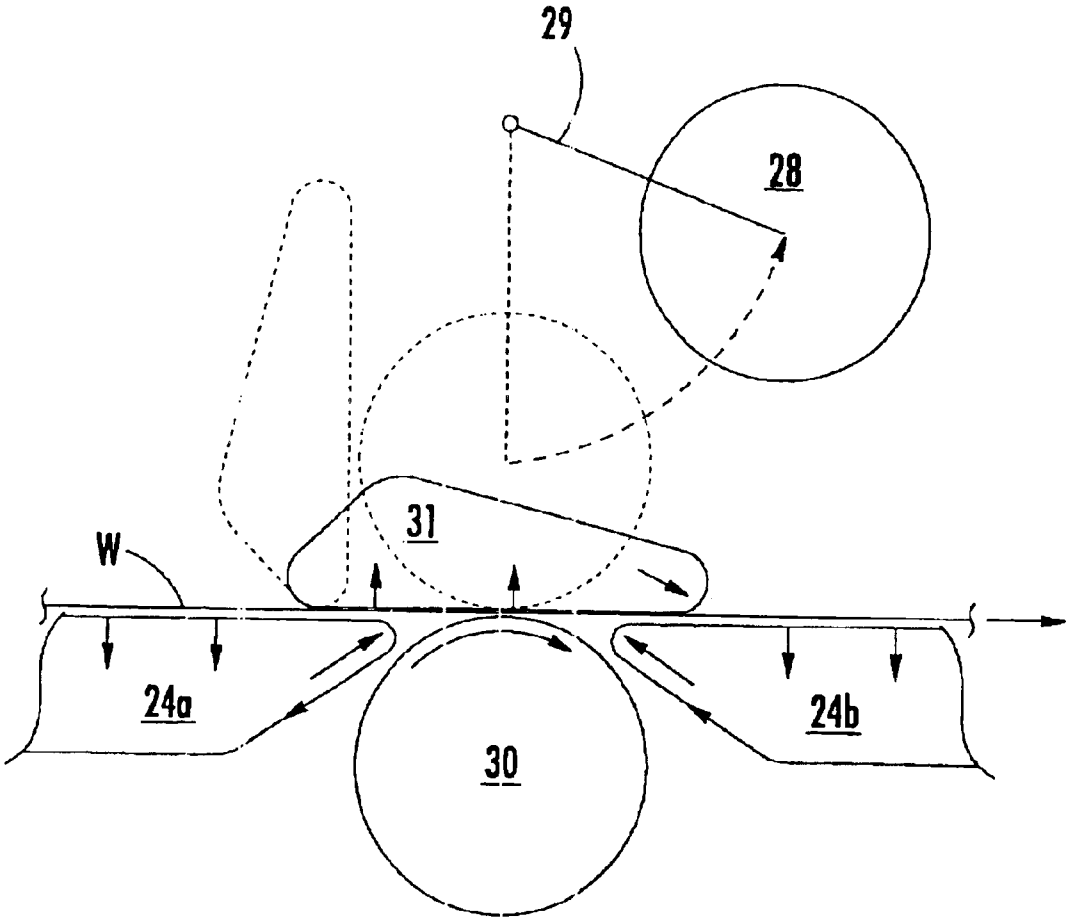
FIG. 4 illustrates an alternative calendering station embodiment in which a calender roll is shown pivoted away from a conveyor while a vacuum transport conveyor simultaneously pivots toward the conveyor during thread-up of the web product.

FIG. 4 shows an alternative to the exemplary embodiment of FIG. 3 in which calender roll 28 is attached to a pivot mechanism 29 if it is desired to thread-up web W without subjecting web W to the calendering nip N. In this example, a vacuum transport conveyor 31 may be pivoted toward conveyor 24 in order to thread web W across an area of the nip N before bringing on the calendar roll 28.

Figure 5:
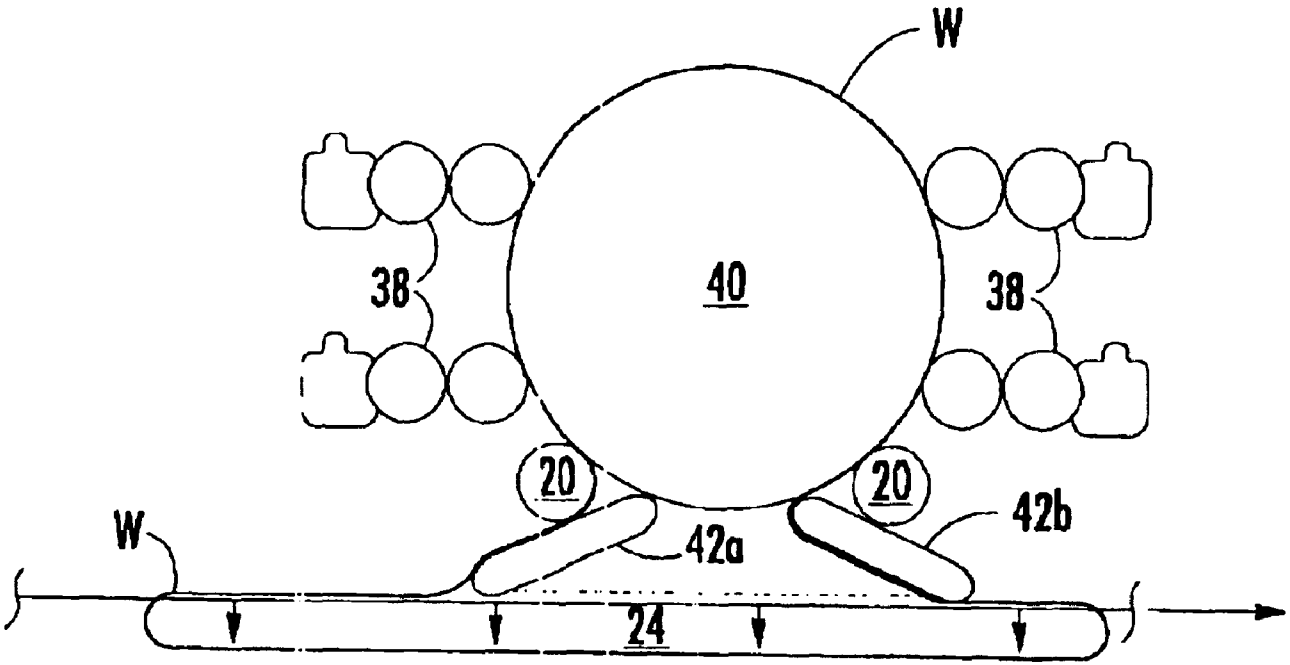
FIG. 5 illustrates an alternative printer station embodiment to the serial printer arrangement at area V of FIG. 1.

FIG. 5 illustrates an alternative printing station to the serial arrangements of FIGS. 1 and 2. In either embodiment, however, printers 38 can be configured to print the web W with multiple colors. It is to be noted that although FIGS. 1, 2 and 5 illustrate four color printing by four printers 38, any number of printer elements are envisioned by the invention.

With more specific reference to FIG. 5, a delivery conveyor 24 is configured with vacuum to hold web W to the conveyor 24. If printing is desired, web W is directed away from delivery conveyor 24 by bypass conveyor 42*a* and onto printer roll 40 for multiple color printing on one or both sides of web W by printers 38. Also indicated above, web W is always continuously supported and moved by conveyor 24, bypass conveyors 42*a, b* and printer roll 40.

Figure 6:
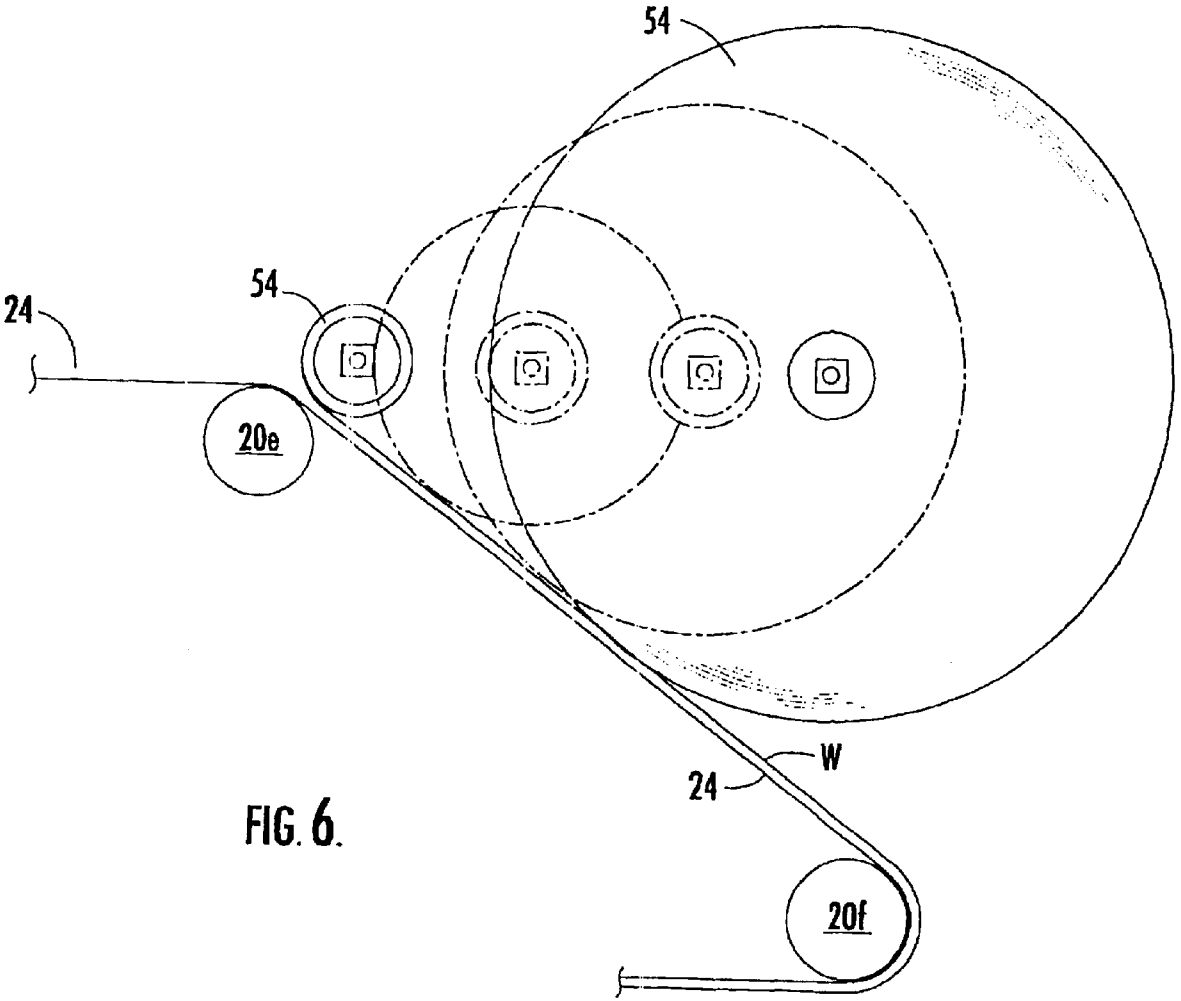
FIG. 6 is an enlarged view of an optional parent roll assembly taken at area VI in FIG. 2 illustrating a parent roll being selectively formed.

FIG. 6 shows in detail the selective formation of a parent roll 54. System 10 may include this option to wind up web W into the parent roll 54 for subsequent processing into consumer-size logs and a final product if it is desired to bypass winder 48.

FIGS. 1–5 also illustrate a method of operation of the invention in which a rolled paper web product may be manufactured and finished without requiring a parent roll reeling step and an unwinding step. The method includes depositing an aqueous suspension of papermaking fibers onto an endless forming fabric to form a wet web W. The wet web W is transferred to a dryer 12 for drying. If desired, the wet web W may be transferred from a forming fabric to an uncreped through-air dryer (UCTAD) to be dried and then rush-transferred from the dryer 12 at an UCTAD operating speed to conveyor 14 wherein the rush-transferred web W defines a molded web. The UCTAD web W can then be processed at various calendering stations.

Alternatively, the exemplary method may include creping the dried web W from the dryer 12. Creped web W is continuously creped, advanced and transferred from the dryer 12 to a first conveyor 14 in a similar manner described in the foregoing exemplary system. Additionally, it should be noted that first conveyor 14 may receive the web W such as by vacuum roll 16, or by direct contact, gravity or the like, and then first conveyor 14 guides the web W toward second conveyor 24.

Drying, picking up, and transferring web W may cause the width of the transferred web W to undesirably narrow. Accordingly, the disclosed method contemplates laterally spreading the web W by a vacuum 36, blow box 37, spreader bar (not shown), Mount Hope roll (not shown) or any combinations of the foregoing as the web W passes between first and second conveyors 14, 24. By way of specific example, vacuum slots (not shown) on vacuum box 36 can be configured proximate the conveyor 24 to pull or spread web W to a desired width. After spreading the web W, it is continuously advanced toward the various converting stations as seen in the Figures and previously described.

According to another aspect of the disclosed method, at least one other pulper 50*b* may be disposed at any point between the first conveyor 14 and the severing device 45. As described above and seen particularly in FIG. 2, pulper 50*b* may be disposed proximate the open draw D to receive a broken portion of web W, while the remaining web W continuously moves in the direction of the winder 48. This alternative exemplary arrangement may couple the generally slower converting processes to the generally faster tissue machine to thereby increase efficiencies of the overall manufacturing and finishing processes as described herein.

The method may also include the step of finishing web W by gluing or otherwise attaching web W to a core (not shown). Optionally, the glue or adhesive can be applied by the gluing device 46 to attach the sheet to the core prior to the start of the winding step. The web W and core can then be rolled into a paper or other web product. If web W proceeds directly to winder 48, the rolled web product may have a diameter of from about 3.5 inches to about 6.5 inches, for example, for a consumer.

It will be apparent to those skilled in the art that various modifications and variations can be made in the present invention without departing from the scope and spirit of the invention, for example, specific shapes of various elements of the illustrated embodiments may be altered to suit particular web formation applications. It is intended that the present invention therefore include such modifications and variations as come within the scope of the appended claims and their equivalents.

That which is claimed is:

1. A method for manufacturing and finishing a rolled paper web product without requiring a parent roll reeling step and an unwinding step, the method comprising the steps of:

a) depositing an aqueous suspension of papermaking fibers onto an endless forming fabric to form a wet web;

b) transferring the wet web to a dryer for drying the wet web;

c) creping the dried web from the dryer to obtain a creped web;

d) continuously advancing and transferring the creped web from the dryer to a first conveyor, the first conveyor being positioned downstream from the dryer and configured to run across pick-up means disposed proximate the dryer for picking up the web;

e) receiving the creped web on the first conveyor by the pick-up means;

f) guiding and continuously supporting the web between the first conveyor and a second conveyor;

g) transversely spreading the web;

h) processing the web at a processing station;

i) transversely perforating the web with a perforator disposed downstream of the processing station such that the web defines a substantially lateral perforation;

j) severing the web along the lateral perforation on the web with a severing device disposed proximate the perforator; and k) winding the web and a core into the rolled paper web product.

2. The method of claim 1, wherein the processing station is selected from the group consisting of a calendering station, an embossing station, a printing station, and combinations thereof.

3. The method of claim 2, wherein the calendering station defines a calendering nip formed by a calender roll and an opposing roll; the embossing station defines an embossing nip formed between a pattern roll and a backing roll, the pattern roll having a surface with a plurality of discrete spot embossing elements separated by a plurality of smooth land areas; and the printing station has a printer configured to print on a surface of at least one side of the web.

4. The method of claim 3, wherein the calender roll is a smooth steel roll and the opposing roll is a resilient rubber roll.

5. The method of claim 3, wherein the printer is disposed upstream of the embossing nip.

6. The method of claim 1, further comprising the substep of applying an adhesive to attach the web to the surface of the core such that the edge of the web to a surface of the core at the start of the winding step.

7. The method of claim 1, further comprising the substep of continuously coating the web with at least one coater.

8. The method of claim 5, wherein the coating substep coats the element with a lotion formulation.

9. The method of claim 6, wherein the lotion formulation includes from between 5 to about 95 weight percent of an emollient, from between 5 to about 95 weight percent of a wax and from between 0.1 to about 25 weight percent of a viscosity enhancer selected from the group consisting of polyolefin resins, polyolefin polymers, polyethylene, lipophilic/oil thickeners, ethylene/vinyl acetate copolymers, silica, talc, colloidal silicone dioxide, zinc stearate, cetyl hydroxy ethyl cellulose and mixtures thereof.

10. The method of claim 1, further comprising the substep of selectively winding the web into a parent roll for subsequent processing before step k).

11. The method of claim 10, further comprising a modular reel and bypass apparatus to selectively wind the parent roll, the modular reel and bypass apparatus disposed proximate the processing station.

12. The method of claim 1, further comprising a pulper for broke handling of the web, the pulper configured to receive a broken portion of the web.

13. The method of claim 12, wherein the pulper is a plurality of pulpers disposed between the first conveyor and the severing device, at least one of the plurality of pulpers disposed proximate a winder in step k) such that the web is continuously moved on the first conveyor.

14. The method of claim 13, further comprising an open draw disposed between the first conveyor and the winder, the draw configured to redirect the broken portion of the web in a direction away from the first conveyor and further comprising the substep of transferring the broken portion of the web to the pulper.

15. The method of claim 1, further comprising a vacuum box to suctionally control and transfer the continuously advancing paper web.

16. The method of claim 1, wherein the web in step g) is spread by a spreading element selected from the group consisting of a vacuum box, a spreader bar, a Mount Hope roll, and combinations thereof.

17. The method of claim 1, further comprising the step of folding the web to create multiply tissue prior to the winding step.

18. The method of claim 1, further comprising means for forming the rolled paper web product with multiple plies.

19. The method of claim 1, wherein the rolled paper web product has a diameter of from between about 3.5 inches to about 6.5 inches.

20. A method for manufacturing and finishing an uncreped through-air dried web product from an aqueous suspension of fibers forming an endless wet web on a forming fabric, the method comprising the steps of:

a) transferring the dried web from the dryer to a conveyor, the dryer and the conveyor configured to cooperate at substantially a single operating speed;

b) continuously advancing the web on the conveyor to a second conveyor, at least one of the conveyor and the second conveyor configured to substantially support the web during a converting process;

c) converting the web in the converting process;

d) perforating the web with a perforator; and e) severing the perforated web with a severing device disposed proximate the perforator to form a finished web product.

21. The method as in claim 20, wherein the converting step is selected from the group consisting of a calendering step, an embossing step, a printing step, and combinations thereof.

22. The method as in claim 21, wherein the calendering step is performed by a calender roll and an opposing roll.

23. The method as in claim 21, wherein the embossing step is performed by a pattern roll and a backing roll.

24. The method of claim 20, further comprising the substep of continuously coating the web with a coater.

25. The method of claim 24, wherein the coater is a coating roller.

26. The method of claim 24, wherein the coater is plurality of coaters configured to coat the web with a plurality of coatings.

27. A method for manufacturing and finishing a rolled paper web product without requiring a parent roll reeling step and an unwinding step, the method comprising the steps of:

a) depositing an aqueous suspension of papermaking fibers onto an endless forming fabric to form a wet web;

b) transferring the wet web to a dryer for through-drying the wet web and forming an uncreped, through-dried web product;

c) continuously advancing and transferring the uncreped, through-dried web product from the dryer to a first conveyor, the first conveyor being positioned downstream from the dryer and configured to run across pick-up means disposed proximate the dryer for picking up the uncreped, through-dried web product;

d) receiving the uncreped, through-dried web product on the first conveyor by the pick-up means;

e) guiding and continuously supporting the uncreped, through-dried web product between the first conveyor and a second conveyor;

f) transversely spreading the uncreped, through-dried web product;

g) processing the uncreped, through-dried web product at a processing station;

h) transversely perforating the uncreped, through-dried web product with a perforator disposed downstream of the processing station such that the uncreped, through-dried web product defines a substantially lateral perforation;

i) severing the uncreped, through-dried web product along the lateral perforation on the uncreped, through-dried web product with a severing device disposed proximate the perforator; and j) winding the uncreped, through-dried web product and a core into the rolled paper web product.

28. The method of claim 27, wherein the processing station is selected from the group consisting of a calendering station, an embossing station, a printing station, and combinations thereof.

29. The method of claim 27, further comprising the substep of selectively winding the web into a parent roll for subsequent processing.

30. The method of claim 29, further comprising a modular reel and bypass apparatus to selectively wind the parent roll, the modular reel and bypass apparatus disposed proximate the processing station.

* * * * *